US008210233B2

(12) United States Patent
Bonci

(10) Patent No.: US 8,210,233 B2
(45) Date of Patent: Jul. 3, 2012

(54) APPARATUS FOR MANUFACTURING METAL ARTICLES, IN PARTICULAR OF LIGHT ALLOY

(75) Inventor: Franco Bonci, Moncalieri (IT)

(73) Assignee: Solmar S.A.S. (IT)

( * ) Notice: Subject to any disclaimer, the term of this patent is extended or adjusted under 35 U.S.C. 154(b) by 853 days.

(21) Appl. No.: 12/341,870

(22) Filed: Dec. 22, 2008

(65) Prior Publication Data

US 2009/0158795 A1 Jun. 25, 2009

(30) Foreign Application Priority Data

Dec. 21, 2007 (IT) ..... TO2007A0934

(51) Int. Cl.
*B22D 18/02* (2006.01)
*B22D 18/08* (2006.01)

(52) U.S. Cl. ..... 164/120; 164/111; 164/112; 72/42

(58) Field of Classification Search ..... 164/63, 164/111, 113, 120; 72/42
See application file for complete search history.

(56) References Cited

U.S. PATENT DOCUMENTS 4,049,040 A * 9/1977 Lynch ..... 164/120
4,183,236 A * 1/1980 Spiegelberg et al. ..... 72/42
4,519,436 A * 5/1985 Ebisawa et al. ..... 164/120
4,991,641 A * 2/1991 Kidd et al. ..... 164/120
5,109,914 A * 5/1992 Kidd et al. ..... 164/113
5,423,369 A * 6/1995 Ota et al. ..... 164/63
5,433,262 A * 7/1995 Kawaguchi et al. ..... 164/120
7,806,162 B2 * 10/2010 Kotagiri et al. ..... 164/111

FOREIGN PATENT DOCUMENTS

EP 1472027 11/2004
WO WO 03/066254 8/2003

* cited by examiner

*Primary Examiner* — David Jones
(74) *Attorney, Agent, or Firm* — Hayes Soloway P.C.

(57) ABSTRACT

An apparatus for manufacturing metal articles, in particular of light, alloy, includes a die including a pair of portions which can be separated to each other, which, in the closed condition, delimitate forging cavities having a shape corresponding to one or more articles to be forged, and a furnace adapted to melt the metal and to control the reaching by the molten metal of the hollow impressions of the die, as a result of overflowing through a duct connected to the furnace. A portion of the die includes, for each hollow impression, a movable punch adapted to apply a predetermined pressure on the relevant article during the forging step. Each punch is moveable in a manner independent from the other punches, and the apparatus includes a controller for controlling the pressure applied by each punch during the forging step, which allow to level the pressure applied by all the punches on the relevant article.

6 Claims, 4 Drawing Sheets

APPARATUS FOR MANUFACTURING METAL ARTICLES, IN PARTICULAR OF LIGHT ALLOY

BACKGROUND OF THE INVENTION

The present invention refers to apparatuses adapted for manufacturing metal articles, in particular of light alloy such as an aluminum alloy, by means of the known method of press—forging by cast in a die (squeeze die cast forging), also known as "liquid forging", by which a molten metal is fed to one or more cavities of a die from a furnace arranged below the die, through a duct associated with the furnace, which metal undergoes a compression during the forging step.

The pressure applied to the metallic material during forging allows to oppose formation of micro-cracks in the forged articles, so that their structure turns out to be more compact and even, and characterized by a higher structural resistance with respect to that obtainable by previously known forging methods.

An apparatus of the type mentioned above, which is known by EP-A-1 472 027, comprises a die which may have a plurality of impressions which allow, for example, to manufacture at the same time a plurality of equal pieces or pieces different to each other during a single forging step. The upper portion of the die includes a series of movable punches, one for each impression of the die, which are rigidly connected to each other so as to undergo simultaneously a same movement with respect to the upper portion of the die, in order that they apply together a pressure on the metal constituting the articles to be forged.

Although this known apparatus turns out to be usually effective in the use, problems may arise when a plurality of articles have to be manufactured during a single forging step, in particular if the number of articles to be forged is high, or when a single article of big dimensions has to be manufactured by applying a pressure at a plurality of different zones thereof during the forging step. Mainly when aluminum based light alloys are used, small differences of temperature between different zones of the die at the impressions of the various articles, or of the single article of big dimensions, may involve differences in the surface tension of the molten metal fed into the impressions, and cause therefore a different dosing of the metal in the various impressions with a resulting different filling.

When the amount of molten metal fed to the various impressions does not correspond exactly to that expected, also the pressure applied to the various articles, or at different zones of a same article, during the forging step may be different from that expected, because of the fact that the various punches are connected to each other so as to move all together with of a same stroke, with the risk that in some forged articles, or at different zones of a same article, micro-cracks may originate, such as to weaken its structure and cause the need to reject them.

SUMMARY OF THE INVENTION

In order to solve this drawback, the present invention provides an apparatus for manufacturing metal articles, in particular of light alloy, which comprises a die including a pair of portions which can be separated to each other, which, in the closed condition, delimitate forging cavities having a shape corresponding to one or more articles to be forged, and a furnace adapted to melt the metal and to control the reaching by the molten metal of the hollow impressions of the die, as a result of overflowing through a duct connected to the furnace.

A portion of the die comprises, for each hollow impression, a movable punch adapted to apply a predetermined pressure on the relevant article during the forging step. Each punch is moveable in a manner independent from the others punches, and the apparatus comprises a controller for controlling the pressure applied by each punch during the forging step, which allow to level the pressure applied by all the punches on the relevant article.

By virtue of the fact that in the apparatus of the invention each punch of the die is adapted to be moved in an independent manner with respect to the others punches, so that the expected optimal pressure for the forging step is applied on each article, or on different portions of a same article, the articles obtained have an even quality, and the risk to produce defective articles is excluded a priori.

Further characteristics and advantages of the invention will be made more clear by the following detailed description, supplied as a non limitative example and referred to the appended drawings in which:

DETAILED DESCRIPTION OF THE INVENTION

Figure 2:
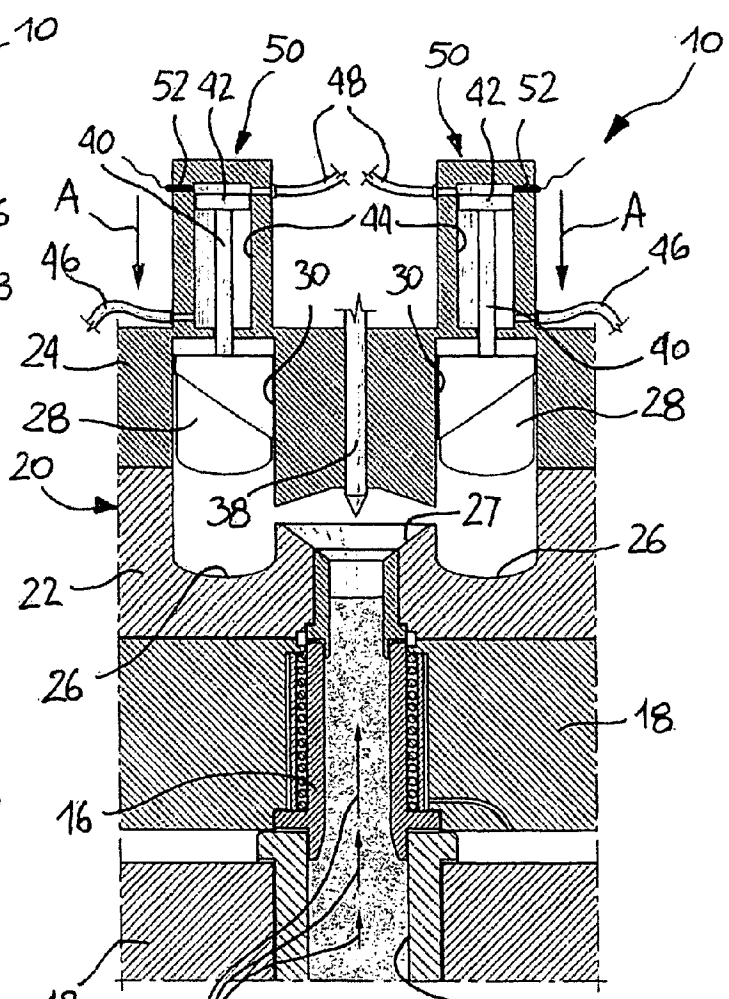
FIGS. 1 to 5 are schematical sectioned side elevational views of an apparatus according to a first modification of the invention, which show consecutive steps of a forging operation.

With initial reference to FIGS. 1 to 5, an apparatus according to the invention is indicated 10 in its whole. The apparatus 10 comprises a frame 12 which includes a furnace (of a type known per se and not shown) adapted to melt a metal fed to it, such as a light alloy, for example an aluminum based alloy. The furnace comprises pressure means (also of a type known per se) intended to cause rising of the molten metal along a feeding duct 14 associated to it.

The duct 14 extends upwards by means of a heated extension 16 crossing a base 18 that supports a die 20 which includes a lower portion 22, fastened to the base 18 in a known per se manner, and an upper portion 24 which can be separated with respect to the lower portion 22.

A series of hollow impressions 26 are formed in the portion 22 of the die 20, arranged around an outlet opening 27 of the feeding duct 14. Each of the various impressions 26, which are shown as a non limitative example as generally cup shaped impressions, may pertain to a different article to be forged, or may correspond to different zones of a single article of big dimensions.

The upper portion 24 of the die 20 is provided with a series of punches 28, the number of which is equal to that of the hollow impressions 26, each of which is slidably and sealingly mounted in a respective cylindrical cavity 30 facing an impression 26.

One end 32 of each punch 28 facing a respective impression 26, has a shaped surface in order to define, together with the relevant impression 26, a forging cavity the shape of which corresponds to an article, or to a zone of a single article of big dimensions, to be manufactured by means of the apparatus 10.

The upper portion 24 of the die is usually provided with an appendage 34 extending towards the outlet opening 27 of the duct 14, in a zone interposed between the punches 28, the perimetral edge 36 of which delimits, together with the edge of the opening 27, in the closed condition of the portions 22 and 24 of the die 20, overflow ports for the molten metal, during feeding thereof to the impressions 26.

A sensor device, indicated 38, may be associated to the appendage 34 in a manner known per se, in order to sense the reaching of a predetermined level by the molten metal and to control, as a result, the interruption of the pressurization of the molten metal in the furnace, in order to stop its rising along the duct 14.

Each punch 28 is fixed at the lower end of a rod 40, the upper end of which is provided with a piston 42 sidably and sealingly mounted in a cylinder 44 adjacent to and separated from the cylindrical cavity 30 of the respective punch 28. Each cylinder 44 is divided by the piston 42 in two opposite half-chambers, each of which is connected with a respective inlet/outlet duct, indicated 46 and 48, for a service fluid.

Each unit associated with a respective punch 28, including a cylinder 44 and a piston 42 with the respective rod 40, constitutes a double-acting actuator 50, for example controlled hydraulically or pneumatically, which allows to control the movement of the relevant punch 28 in a manner independent from the other punches 28.

A pressure sensor 52 is arranged in the half-chamber of each actuator 50 opposite to the punch 28. The sensors 52 of the various actuators 50 are connected by conductors with an electronic control unit (not shown) which receives the signals from the sensors 52 and compare them in order to control the movement of each actuator 50 in an independent manner until each sensor 52 sense that a predetermined forging pressure has been reached, this pressure being the same in each cylinder 44. In this manner, it is possible to assure that each punch 28 applies a pressure equal to that of the others punches 28 on the metal of the article to be forged, and that the pressure applied by the various punches 28 is exactly levelled with respect to a predetermined value.

Figure 1:
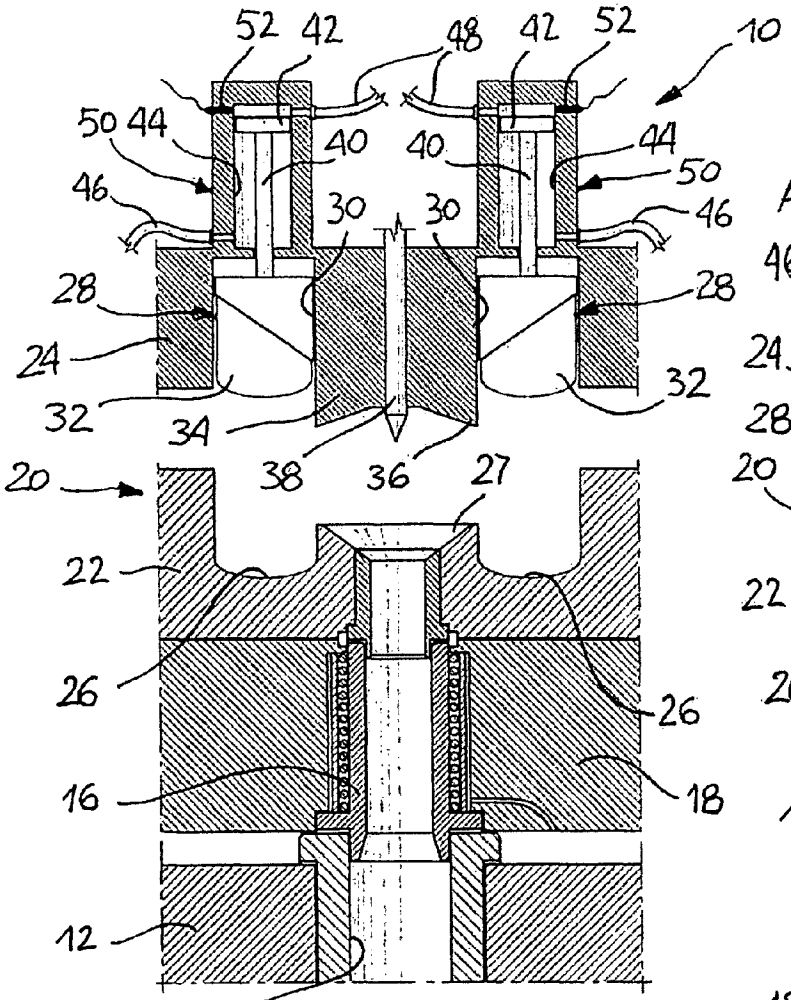
Figure 4:
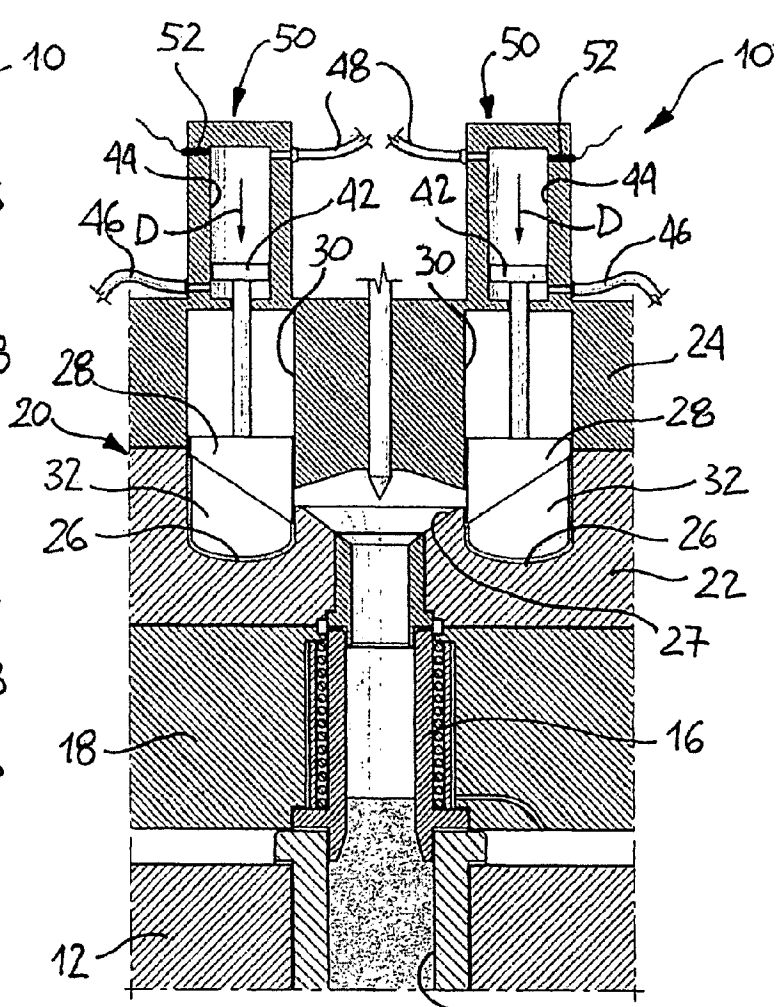
Figure 3:
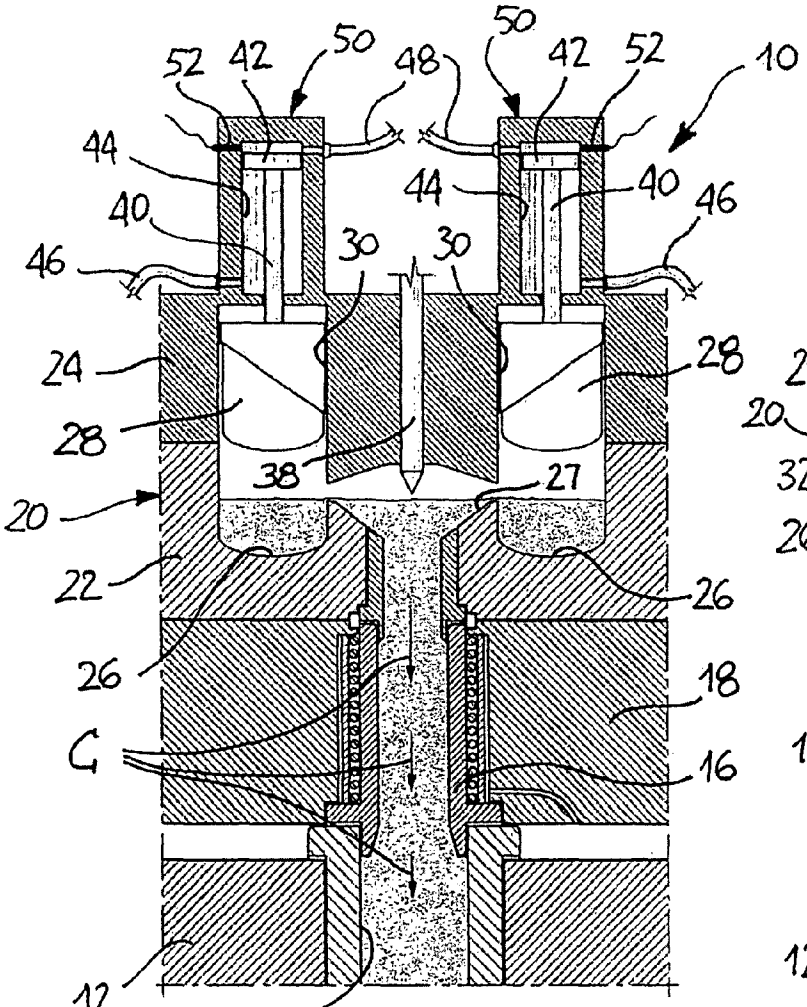

In a first operational step shown in FIG. 1, the die 20 is open being its portions 22 and 24 separated, and the punches 28 are arranged in a back rest position with respect to the relevant cavities 30.

At the beginning of the forging step, the die 20 is closed by controlling the vertical movement of the portion 24 in the direction indicated by arrows A in FIG. 2, as a result of the driving of a press unit associated with the apparatus 10 in a known per se manner. When the die 20 is closed, it is heated and the pressure means of the furnace are operated In order to cause the molten metal to rise along the duct 14, as indicated by arrows B of FIG. 2. The molten metal overflows through the ports formed between the edge of the outlet opening 27 and the edge 36 of the appendage 34, until the impressions 26 are filled up according to a dosing predetermined by the configuration of the edge of the opening 27 with respect to the bottom of the impressions 26. As a result of sensing the reaching of the opening 27 by the molten metal by means of the sensor 38, stopping of the pressure means of the furnace is operated, so that the molten metal goes down along the duct 14, towards the furnace (arrows C of FIG. 3)

The electronic control unit of the apparatus 10 controls driving of the actuators 50 30 as to cause advancing of the punches 28 (arrows D of FIG. 4) towards the impressions 26, as a result of feeding the pressurized fluid in the upper half-chambers of the actuators 50. In this manner, the punches 28 apply a compressive force on the molten metal which is present in the impressions 26, which causes both the complete filling of the cavities defined between the impressions 26 and the shaped surfaces of the ends 32 of the punches 28, that is of the cavities defining the shape of the articles or of the article to be forged, and the application of an over-pressure on the metal, which will be usually maintained during the forging step and the successive cooling step.

In particular, the movement of the various punches 28 towards the impressions 26 takes place in an independent manner, each of the actuators 50 being stopped when the value of the pressure sensed by the respective pressure sensor 52 is levelled with the value of pressure predetermined for forging as well as with that sensed by the other sensors 52, in such a manner that all the articles, or all the zones of a same article, undergo the same forging pressure.

Figure 5:
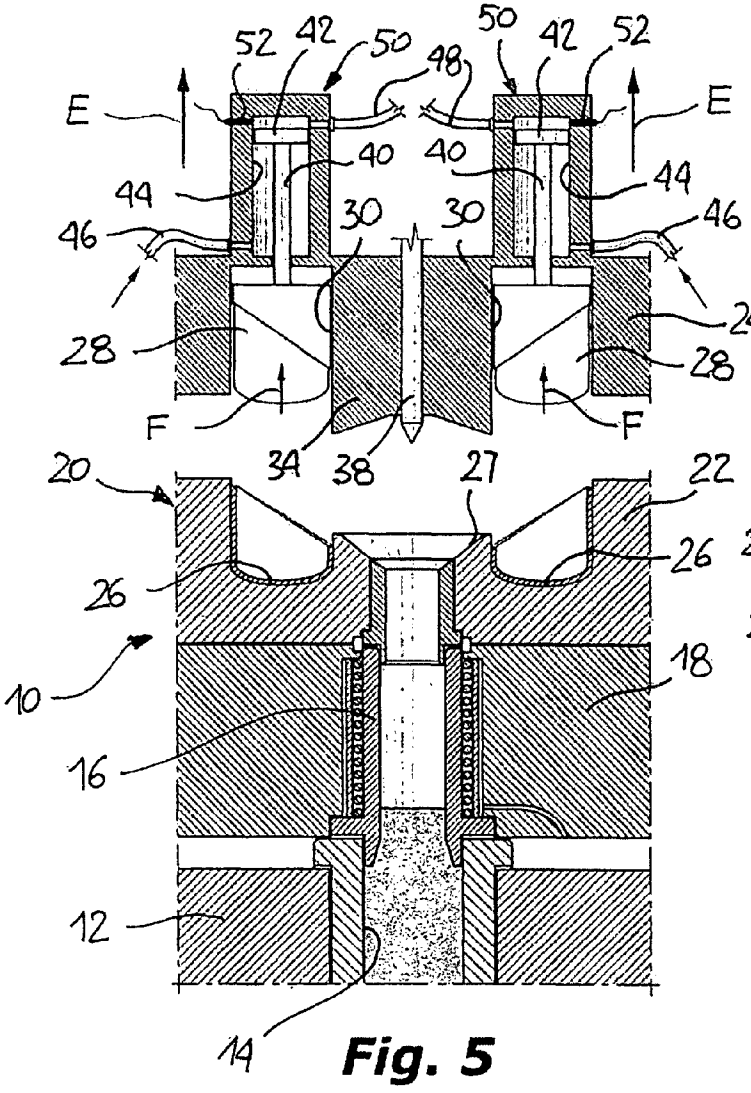

When the cooling step of the die 20 is ended, it is opened by moving its upper portion 24 away from the lower portion 22, along the direction indicated by arrows D of FIG. 5, and the punches 28 are brought again in their back position (arrows F of FIG. 5) by feeding pressurized fluid in the lower half-chambers of the actuators 50. The articles or the article obtained by forging, remain in the impressions 26, waiting for a knockout step to be executed in usual manners.

Figure 6:
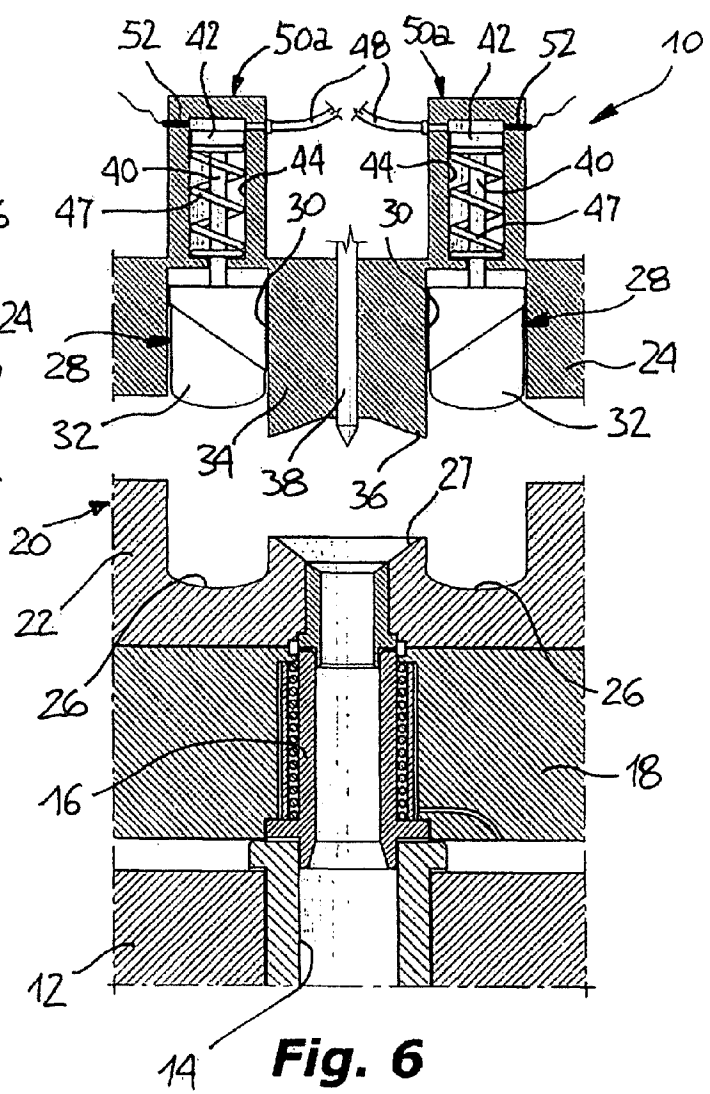
FIG. 6 is a view similar to FIG. 1, of a second modification of an apparatus according to the invention.

According to a modification of the invention shown in FIG. 6, in which the same numeral references have been used to indicate parts equal or similar to those of the previous modification, the actuators for driving the punches 28, indicated as a whole by reference 50*a*, are of the single-acting type. The actuators SQa comprise a thrust spring 47 arranged in the lower half-chamber of the cylinder 44, that is on the side of the pistons 42 more adjacent to the cylindrical cavities 30, while their upper half-chamber, with the pressure sensors 52 associated to it, can be selectively fed with pressurized fluid through ducts 48 in order to cause the movement of the punches 28 towards the impressions 26 of the lower portion 22 of the die 20. The various operational steps of the apparatus remain substantially analogous to those described with reference to the previous modification.

In spite of the fact that the actuators 50 and SQa described with reference to the previous modifications are of the fluid operated type, they may be replaced, with small changes in the capacity of the skilled person, by electrically driven actuators (not shown), for example of the worm-screw type, in which case the pressure sensors 52 are associated with such electrically driven actuators so as to sense the pressure applied by them during the thrust step of the punches 28.

Figure 7:
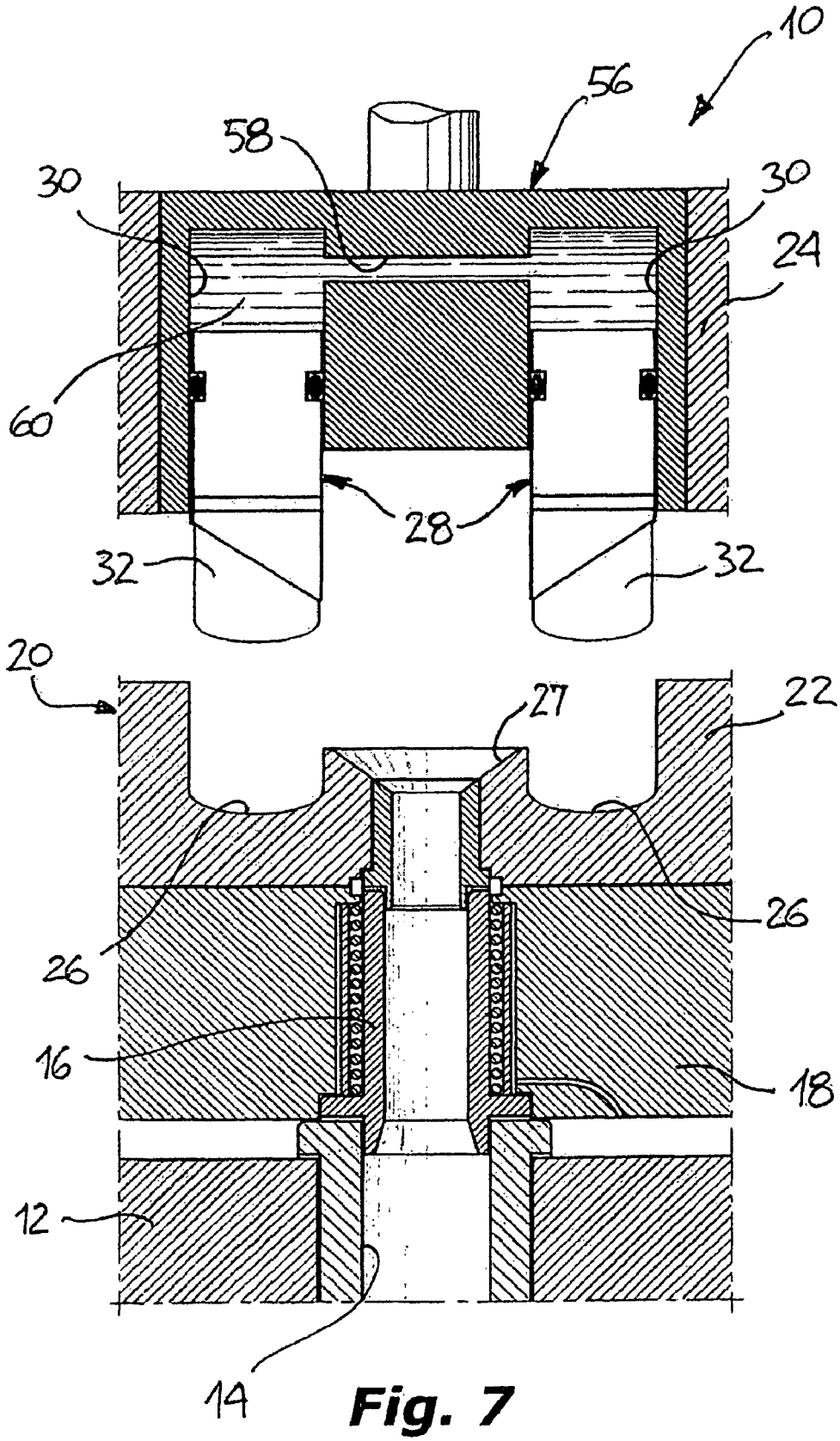
FIG. 7 is a view similar to FIG. 1, of a third modification of an apparatus according to the invention.

According to another modification shown in FIG. 7, in which the same numeral references have been used to indicate parts equal or similar to those of the previous modifications, the apparatus 10 may comprise a simplified device for driving the punches 28, which does need neither the presence of pressure sensors nor an electronic control unit for managing the operation of the actuator devices.

In this case, the upper portion 24 of the die 20 comprises a unit 56 in which the cylindrical cavities 30 are formed, in which the punches 28 are slidably and sealingly mounted. The upper portion of each cavity 30, above the body of the respective punch 28, communicates with the upper portion of the other cavities 30 by means of service ducts 58 (only one of which can be seen in FIG. 7), the volume of the upper portion of the various chambers 30 as well as of the ducts 58 being filled up with a liquid 60, usually oil.

When the die 20 is closed, as a result of the movement of its upper portion 24 towards its lower portion 22, the punches 28 apply, on the molten metal present in the impressions 26, a pressure which is automatically levelled as a result, of the movement of the liquid 60 between the various cavities 30, by virtue of an independent movement of the various punches 28, until each of them applies on the relevant articles, or at different zones of a same article, the same forging pressure. Also in this case, the various operational steps of the apparatus are substantially analogous to those described with reference to the previous modifications, except for the control step of the movement of the punches 28 which is not provided for, since the actuators, which are replaced by the unit 56, are lacking.

What is claimed is:

1. An apparatus for die forming metal articles from a molten metal said apparatus including a first die portion and at least a second die portion which are moveable relative to one another between an open condition and a closed condition, said die portions, in a closed condition, delimiting die cavities which define a shape of one or more articles to be formed, the apparatus further comprising a furnace arranged below and connected to the die by a feeding duct, to heat a metal to its molten state and to control a flow of the molten metal through the feeding duct to hollow impressions formed as part of the first or the second portion of the die, said apparatus further comprising a moveable punch located in each hollow impression, which punch is movable towards the other portion of the die, and is adapted to apply a predetermined pressure on the metal article being formed, wherein each punch is moveable independently from all other punches, said apparatus further comprising a controller for controlling a pressure applied by each punch and for levelling the pressure applied by all the punches on the article being formed.

2. The apparatus according to claim 1, wherein a movement of each punch is controlled through a respective actuator to which a sensor is associated, wherein each sensor is adapted to sense a pressure applied by its respective punch, the actuators and their respective sensors being connected to an electronic control unit adapted to control driving of the actuators until all the sensors sense a pressure which is substantially equal to and corresponding to a predetermined pressure.

3. The apparatus according to claim 2, wherein each punch is controlled through a double-acting hydraulic or pneumatic actuator comprising a piston connected to a respective punch, which piston is slidably mounted in a cylinder in which a first half-chamber arranged on a side of the respective punch and a second half-chamber opposite to the first chamber are defined at opposite sides of the piston, and half-chambers are respectively fed with said pressurized fluid through respective ducts, said pressure sensor being arranged in the second half-chamber.

4. The apparatus according to claim 2, wherein each punch is controlled through a single-acting hydraulic or pneumatic actuator comprising a piston connected with a respective punch, slidably mounted in a cylinder in which a first half-chamber arranged on a side of the respective punch and a second half-chamber opposite to the first chamber are defined at opposite sides of the piston, and a resilient thruster is arranged in the first half-chamber for biasing movement of said piston towards the second half-chamber, the second half-chamber being fed with said pressurized fluid through a respective duct, said pressure sensor being arranged in the second half-chamber.

5. The apparatus according to claim 1, wherein each punch is slidably and sealingly mounted in a respective liquid-filled cylindrical cavity, wherein the cavities of said punches communicate with one another through ducts, and wherein movement of the punches is automatically levelled as a result of the movement of the liquid from one cavity to another cavity.

6. The apparatus according to claim 5, wherein the liquid comprises an oil.

* * * * *